US006311028B1

(12) United States Patent
Matsudaira

(10) Patent No.: US 6,311,028 B1
(45) Date of Patent: Oct. 30, 2001

(54) FIXING APPARATUS WITH CONTROLLED HEATERS

(75) Inventor: Tadashi Matsudaira, Tokyo (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/328,736

(22) Filed: Jun. 9, 1999

(30) Foreign Application Priority Data

Jun. 12, 1998 (JP) ..... 10-165084

(51) Int. Cl.[7] ..... G03G 15/20; H05B 1/00
(52) U.S. Cl. ..... 399/69; 219/216; 399/67
(58) Field of Search ..... 219/216; 399/67, 399/69, 70, 328

(56) References Cited

U.S. PATENT DOCUMENTS

| | | | | |
|---|---|---|---|---|
| 4,259,565 | | 3/1981 | Ogino et al. . | |
| 5,512,993 | * | 4/1996 | Endo et al. | 399/69 |
| 5,819,134 | * | 10/1998 | Sato et al. | 399/69 |
| 5,978,618 | * | 11/1999 | Yamamoto et al. | 399/69 |
| 6,008,829 | * | 4/1999 | Wakamiya et al. | 399/69 |

OTHER PUBLICATIONS

European Search Report EP 99 –1 1250.
Patent Abstracts of Japan, Publication #59111669, Publication date: Jun. 27, 1984 (one page of English Abstract).
Patent Abstracts of Japan, Publication #10061959.
Publication date: Mar. 6, 1998 (one page of English Abstract).
Patent Abstracts of Japan, Publication #61156079.
Publication date: Jul. 15, 1986 (one page of English Abstract).

* cited by examiner

*Primary Examiner*—Arthur T. Grimley
*Assistant Examiner*—Hoang Ngo
(74) *Attorney, Agent, or Firm*—Jordan B. Bierman; Bierman, Muserlian and Lucas

(57) ABSTRACT

A fixing apparatus for controlling fixing temperature by controlling operations of a plurality of heaters, the apparatus includes: a timer for measuring a period of time for operations of the plurality of heaters; and a controller for controlling operations of the plurality of heaters in accordance with the measured period of time by the timer. When the timer detects that a period of time of continuous operations of only a part of heaters from among the plurality of heaters reaches a predetermined period of time or more, the controller turns on remaining heaters other than the part of heaters in addition to the part of heaters.

5 Claims, 2 Drawing Sheets

FIXING APPARATUS WITH CONTROLLED HEATERS

BACKGROUND OF THE INVENTION

The present invention relates to a fixing apparatus by which a toner image formed by an electrophotographic method is fixed on the recording sheet, and particularly to a roller fixing apparatus and a belt fixing apparatus, by which the toner image is heated and fixed.

In a heat roller fixing apparatus, it is widely conducted that temperature of the fixing apparatus is controlled to a predetermined value by using a fixing temperature sensor such as a thermistor, or the like. In this case, it is normally conducted that a variation of the fixing temperature is reduced by using a plurality of heaters and by respectively on/off controlling them, and thereby fine fixing effects and stable fixing performance are secured.

In the on/off control of such the conventional fixing apparatus, there are following problems.

An image forming apparatus such as a copier, facsimile apparatus, into which the fixing apparatus according to the present invention is incorporated, is widely used in offices or shops, and is one of apparatus which are operated by the largest current. Almost all of the current supplied into the image forming apparatus is consumed in heaters of the fixing apparatus. Accordingly, power supply voltage is fluctuated when large current of heaters of the fixing apparatus is turned on/off, and the voltage supply onto the other apparatus in the room in which the image forming apparatus is installed, is affected. That is, such phenomena occur that illumination lamps in the room such as fluorescent lamps and incandescence lamps, flicker, thereby, environmental conditions of the room are badly affected.

In the present situation in which many OA apparatus are fully installed in the room and thereby, the environmental condition of the room is going to be worse, such the flicker of the room lamps is a problem to be solved. In the world, there is the trend to regulate such the flicker of the room lamps by regulations.

In the conventional technology in which the plurality of heaters are individually on/off controlled based on the fixing temperature sensors, there is a problem that the number of times of on/off operations is large, and thereby the number of occurrence of flickers is high.

SUMMARY OF THE INVENTION

Accordingly, an object of the present invention is to solve such the problem in the conventional technology, and to provide a fixing apparatus by which the flicker of the illumination lamp in the room, in which an image forming apparatus is installed, is reduced.

The object of the present invention is attained by any of the following structures (1)–(7).

Structure (1): An fixing apparatus in which a plurality of heaters are provided; image formation is carried out by turning on a part of the plurality of heaters; and heaters are controlled such that when fixing temperature is lowered, all heaters are turned on, thereby the lowered temperature is recovered, wherein, when it is measured by a timer that continuous on-time of a part of heaters exceeds the predetermined time, such control is carried out that the remaining heaters in addition to the part of heaters are turned on, thereby, the lowered temperature is recovered.

Structure (2): The fixing apparatus according to Structure (1), wherein the fixing apparatus has a fixing temperature sensor to detect the fixing temperature, and when it is detected by the fixing temperature sensor that the fixing temperature exceeds a first predetermined value, such control is carried out that all of the plurality of heaters are turned off.

Structure (3): The fixing apparatus according to Structure (1), wherein the fixing apparatus has a fixing temperature sensor to detect the fixing temperature, and when it is detected that the fixing temperature exceeds a second predetermined value by turning on the other heaters, the timer is reset.

Structure (4): The fixing apparatus according to Structure (1), wherein the fixing apparatus has a fixing temperature sensor to detect the fixing temperature, and when it is detected that the fixing temperature exceeds a second predetermined value by turning on the other heaters, the other heaters are turned off.

Structure (5): The fixing apparatus according to Structure (4), wherein, when the fixing temperature is not higher than the first predetermined value by turning off the other heaters, the timer is started.

Structure (6): The fixing apparatus according to Structure (5), wherein the fixing apparatus has a fixing temperature sensor to detect the fixing temperature, and when it is detected that the fixing temperature is not higher than the first predetermined value, the timer is started.

Structure (7): The fixing apparatus according to any of Structures (1) to (6), wherein the part of heaters has a calorific value necessary for keeping the fixing temperature in the vicinity of the temperature required for fixing the toner image during image formation.

DETAILED DESCRIPTION OF THE PREFERRED EMBODIMENT (1) Fixing apparatus

Figure 1:
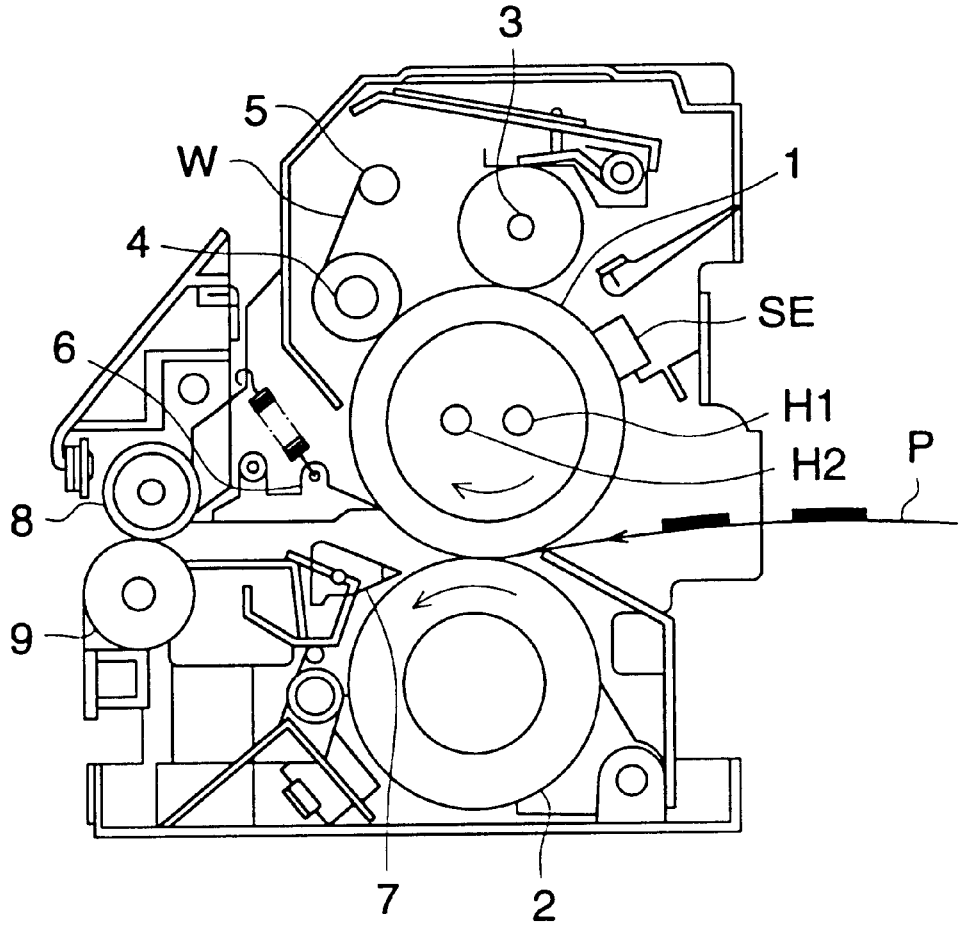
FIG. 1 is a sectional view of a fixing apparatus according to an example of the present invention.

FIG. 1 is a sectional view of a fixing apparatus according to an example of the present invention. In FIG. 1, numeral 1 is an upper roller, and such a roller is used that a silicon rubber layer is formed on a core metal formed of a metallic pipe, and a heat resistant releasing layer such as PFA (perfluoroalkyl vinyl ether) or PTFE (polytetrafluoroethylene), is provided thereon as a surface layer. Numeral 2 is a lower roller, and such a roller is used that a silicon rubber layer is provided on the core metal. Two heaters H1 and H2 which are composed of halogen lamps, are provided in the upper roller 1. The upper and lower rollers 1 and 2 are rotated as shown by an arrow while being in pressure contact with each other with aid of springs, not shown, and fix a toner image on the recording sheet P introduced between them. Numeral 3 is a master roll of a cleaning web W, and the cleaning web W is wound up around a winding roller 5 through a guide roller 4 at extremely slow speed. Numerals 6 and 7 are separation claws to separate the recording sheet P from the upper and lower rollers 1 and 2, and numerals 8 and 9 are sheet delivery rollers to deliver the recording sheet P from the fixing apparatus. A symbol SE is a fixing temperature sensor composed of a thermistor, and detects the surface temperature of the upper roller 1.

A feature of the fixing apparatus is that two heaters H1 and H2 are used as a heat source to heat the upper roller. As will be described later, the heater H1 is a primary heater used for keeping the fixing temperature during image formation, and the heater H2 is a subsidiary heater used for control to keep the necessary temperature when the fixing temperature is lowered as a result of continuous image formation.

In the fixing process, energy is supplied in order to make up for the heat taken by the recording sheet passing through between the upper and lower rollers 1 and 2, or the heat radiated from the roller surface, and in the present example, the energy is mainly replenished by the heater H1. That is, the electric power supplied to the heater H1 is set to the minimum value necessary to make up for the lowering of heat in the continuous fixing process. From such the object, the electric power to be supplied to the heater H1 is preferably about 800–1000 W.

When fixing is conducted by supplying electric power of such the value to the heater H1, the supplied calorific value is insufficient, thereby it is necessary to supply energy to the heater, in fixing for thick sheets, or fixing of an image whose density is high and toner amount is large. The heater H2 is used for making up for the energy. The electric power to be supplied to the heater H2 is preferably about 300–600 W.

(2) Control of heaters in the fixing apparatus

Figure 3:
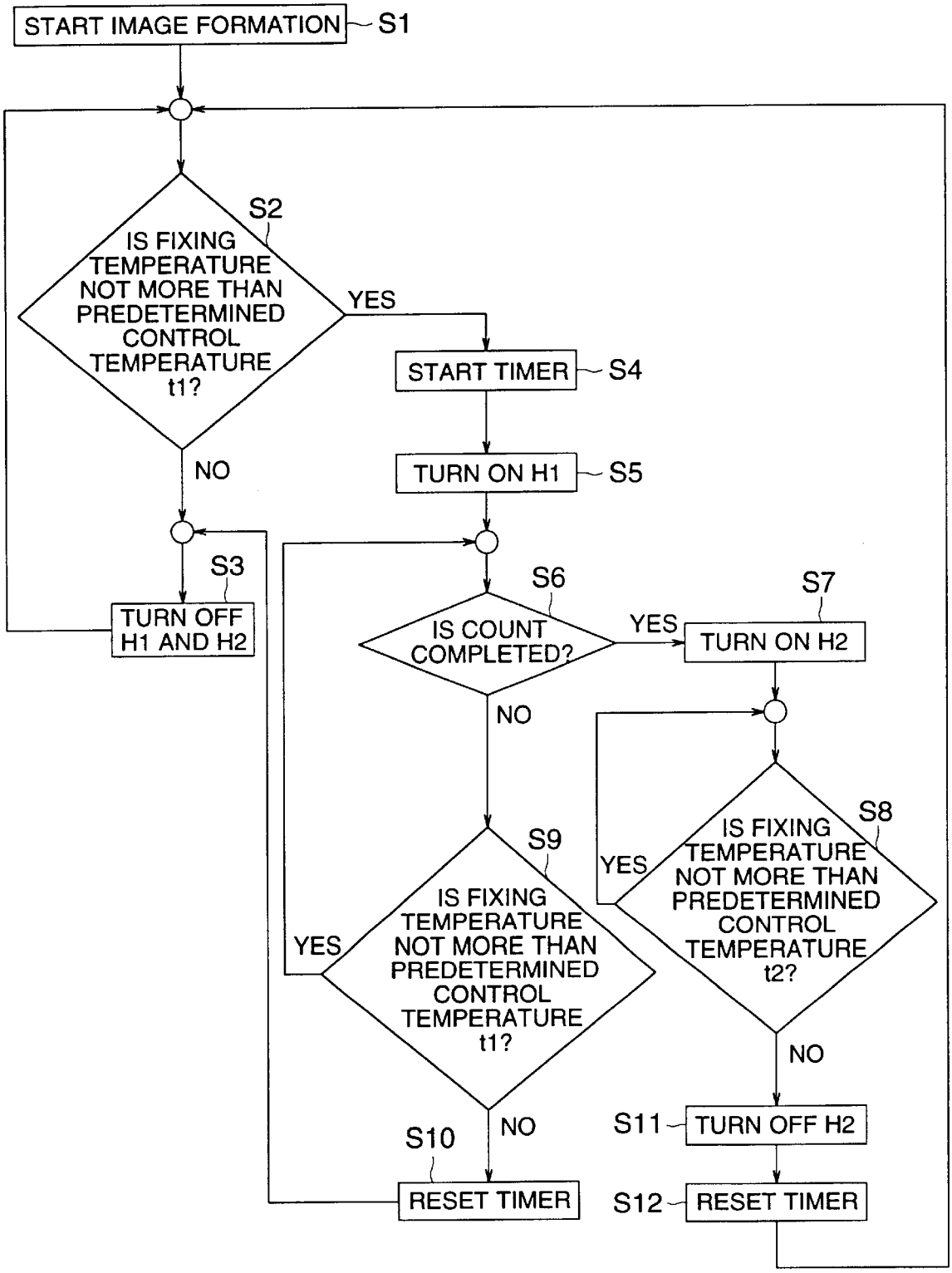
FIG. 3 is a flow chart of the control of the fixing apparatus in Example 1 of the present invention.

The electric power supply control to the heater H1 used as the primary heater, and the heater H2 used as the subsidiary heater, is carried out based on the control program which will be described below. Referring to FIG. 3, the power supply control will be described below.

Figure 2:
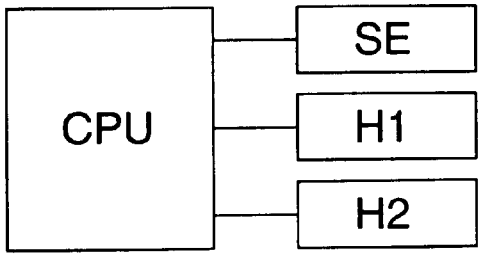
FIG. 2 is a block diagram of a control circuit of the fixing apparatus shown in FIG. 1.

FIG. 3 is a flow chart of a control program of a control section CPU, composed of a microcomputer, shown in FIG. 2.

In the start of image formation (S1), the surface temperature of the upper roller 1 is a predetermined fixing temperature. In this connection, the control of heaters H1 and H2, which are on standby, of the fixing apparatus before the start of image formation, will be described later.

After the start of image formation (S1), it is judged whether or not the fixing temperature is not more than a predetermined control temperature t1 (S2), according to a signal from a sensor SE to detect the surface temperature of the upper roller 1 to fix a toner image, that is, the fixing temperature. The predetermined value t1 is set to the upper limit temperature for fixing the toner image, for example, 160–220°C. When the detected temperature is higher than the predetermined value t1, heaters H1 and H2 are turned off (S3).

When the fixing temperature (the surface temperature of the upper roller 1) is lowered by turning off heaters H1 and H2 and not more than the predetermined value t1, a timer starts (S4). Simultaneously with the start of the timer, the heater H1 is tuned on. Incidentally, in Step S2, when the heater H1 is on, Step S5 is the step to confirm whether the heater H1 is on. When the heater H1 is on, the fixing temperature is maintained at a value near the predetermined value t1. When counting by the timer is completed, that is, time is up (S6), the heater H2 is tuned on. Fixing is carried out during counting by the timer, and the heat is consumed, and as the result of that, the fixing temperature of the upper roller 1 is lowered, therefore, turning-on of the heater H2 compensates for the lowering of the temperature. As the result, the fixing temperature rises with aid of heating by two heaters H1 and H2, and in this heating process, it is judged whether or not the fixing temperature is not more than a predetermined value t2 (S8). The predetermined value t2 is a value which is the same as the predetermined value t1, or little smaller than the value t1, for example, about 0–15°C. lower than t1.

When the fixing temperature reaches the predetermined value t2, the subsidiary heater H2 is turned off (S11), and the timer is reset (S12).

After the timer is reset, the sequence returns to Step S2, and enters the above-described control routine. Step 9 is provided to lower the fixing temperature when the fixing temperature exceeds the predetermined value t1 with aid of heating by only the heater H1.

The fixing process is carried out through the control cycle starting from Step S2, through Steps S7 and S12, and returning to Step S2.

The feature of the present example described above is as follows: the heater H1 serving as the primary heater is basically turned on continuously, and the heater H1 is turned off only when the fixing temperature exceeds the predetermined value t1; and the heater H2 for the auxiliary control is turned on based on the time set by the timer. According to such the time control, the frequency of on/off of heaters H1 and H2 can be reduced, and flickering of the room lamp can be suppressed.

Incidentally, two heaters are used in the above example, however, it is of course that a plurality of heaters, that is, an arbitrary number of heaters may be used.

Further, the control before the image formation will be described below. Worming up after the main switch is turned on, is carried out in the same manner as the conventional one, and both of heaters H1 and H2 are turned on, thereby the surface temperature of the upper roller 1 is quickly increased. While the fixing apparatus is on standby after worming up, such the control is carried out that the surface temperature of the upper roller 1 is kept at a value at which the desirable fixing can be carried out, by the on/off control of the heater H2.

The on/off control of the heater in the fixing apparatus is carried out based on the time set by the timer, thereby, the interval of the on/off control can be set as long as necessary, and the flickering of the illumination lamps in the room in which the image forming apparatus is installed, can be reduced.

What is claimed is:

1. A fixing apparatus for controlling fixing temperature by controlling operations of a plurality of heaters, said apparatus comprising:

(a) a timer for measuring a period of time for operations of the plurality of heaters;

(b) a controller for controlling operations of the plurality of heaters in accordance with the measured period of time by the timer; and (c) a fixing temperature sensor for detecting a fixing temperature;

wherein the controller turns off all of the plurality of heaters when the sensor detects that the fixing temperature reaches not less than a first predetermined value capable of fixing the first predetermined value representing an upper limit fixing temperature, the controller turns on only a part of heaters from among the plurality of heaters and makes the timer to begin measurement when the sensor detects that the fixing temperature reaches not more than the first predetermined value, and the controller turns on remaining heaters other than the part of heaters in addition to the part of heaters from among the plurality of heaters when a period of time of continuous operations of the part of the plurality of heaters reaches more than a predetermined period of time.

2. The fixing apparatus of claim 1, wherein said part of heaters have a minimum calorific value required for fixing.

3. The fixing apparatus of claim 1, wherein said predetermined period of time is defined as a time in which an amount of heat supplied from only said part of heaters is not sufficient for appropriate fixing, which supply of an amount of heat from remaining heaters other than said part of heaters is required.

4. The fixing apparatus of claim 1 further comprising a fixing temperature sensor for detecting a fixing temperature, wherein after the controller turns on remaining heaters among the plurality of heaters in addition to said part of heaters, when the sensor detects that the fixing temperature reaches a temperature more than a second predetermined value representing a temperature capable of fixing, the controller makes said remaining heaters other than said part of heaters to be turned off.

5. The fixing apparatus of claim 4, wherein when the sensor detects that the fixing temperature reaches a temperature more than said second predetermined value, the controller makes said timer to be reset.

* * * * *